US008025748B2

(12) United States Patent
Parson et al.

(10) Patent No.: US 8,025,748 B2
(45) Date of Patent: Sep. 27, 2011

(54) AL—MN BASED ALUMINUM ALLOY COMPOSITION COMBINED WITH A HOMOGENIZATION TREATMENT

(75) Inventors: Nicholas Charles Parson, Kingston (CA); Alexandre Maltais, Chicoutimi (CA)

(73) Assignee: Rio Tinto Alcan International Limited, Montreal (CA)

( * ) Notice: Subject to any disclaimer, the term of this patent is extended or adjusted under 35 U.S.C. 154(b) by 0 days.

(21) Appl. No.: 12/481,386

(22) Filed: Jun. 9, 2009

(65) Prior Publication Data

US 2009/0301611 A1 Dec. 10, 2009

Related U.S. Application Data

(63) Continuation-in-part of application No. 12/136,559, filed on Jun. 10, 2008, now abandoned.

(51) Int. Cl.
*C22C 21/00* (2006.01)

(52) U.S. Cl. ..... 148/437; 420/553

(58) Field of Classification Search ..... 148/437; 420/553, 548, 551

See application file for complete search history.

(56) References Cited

U.S. PATENT DOCUMENTS

| | | | | |
|---|---|---|---|---|
| 3,219,491 | A | 11/1965 | Anderson et al. | |
| 3,951,764 | A | 4/1976 | King | |
| 5,286,316 | A | 2/1994 | Wade | |
| 6,413,331 | B1 * | 7/2002 | Hurd et al. | 148/528 |
| 6,536,255 | B2 | 3/2003 | Kraft | |
| 6,638,377 | B2 | 10/2003 | Koyama et al. | |
| 6,939,417 | B2 | 9/2005 | Marois et al. | |
| 2002/0007881 | A1 * | 1/2002 | Daaland et al. | 148/440 |
| 2003/0102060 | A1 | 6/2003 | Daaland et al. | |
| 2006/0231170 | A1 * | 10/2006 | Parson et al. | 148/437 |

FOREIGN PATENT DOCUMENTS

| | | |
|---|---|---|
| CA | 1203457 | 4/1986 |
| CA | 1308630 | 10/1992 |
| CN | 1752248 | 3/2006 |

* cited by examiner

*Primary Examiner* — Roy King
*Assistant Examiner* — Janelle Morillo
(74) *Attorney, Agent, or Firm* — Banner & Witcoff, Ltd.

(57) ABSTRACT

An extrudable aluminum alloy billet includes an aluminum alloy composition including, in weight percent, between 0.90 and 1.30 manganese, between 0.05 and 0.25 iron, between 0.05 and 0.25 silicon, between 0.01 and 0.02 titanium, less than 0.01 copper, less than 0.01 nickel, and less than 0.05 magnesium, the aluminum alloy billet being homogenized at a temperature ranging between 550 and 600° C.

16 Claims, 6 Drawing Sheets

Fig 6. Conductivity and Dispersoid Particle Density vs . Homogenisation Temperature.
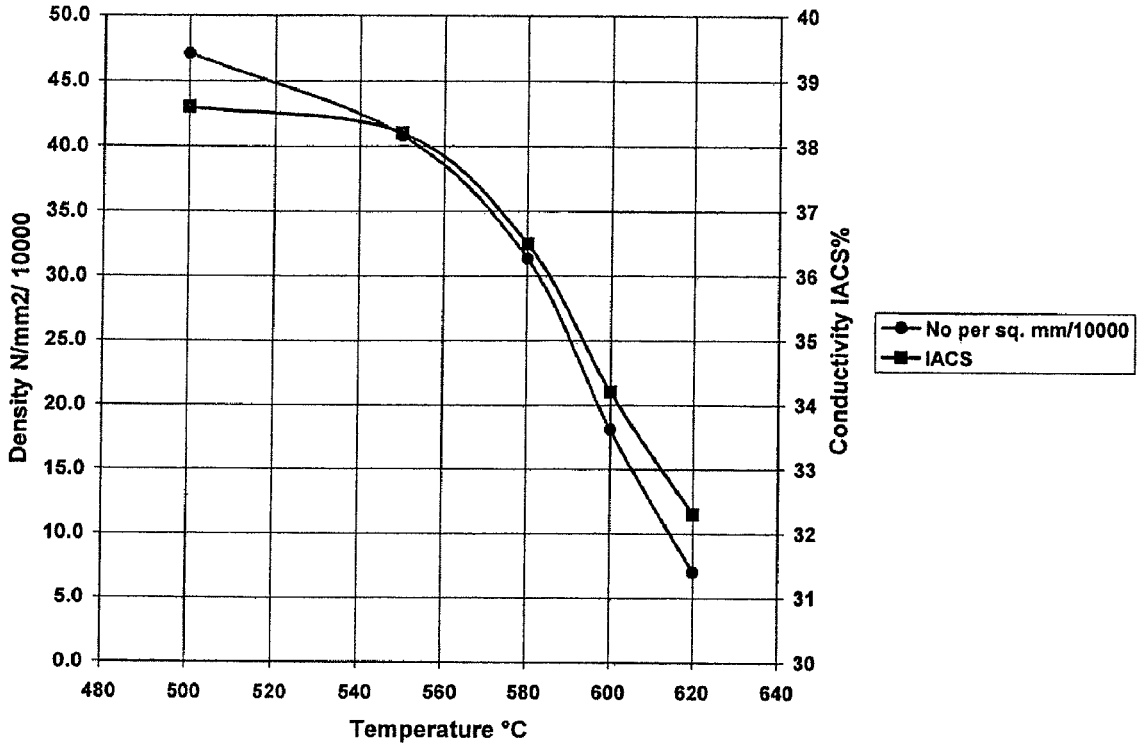

AL—MN BASED ALUMINUM ALLOY COMPOSITION COMBINED WITH A HOMOGENIZATION TREATMENT

CROSS REFERENCE TO RELATED APPLICATIONS

The present application is a Continuation-in-Part of U.S. patent application Ser. No. 12/136,559 filed on Jun. 10, 2008, the content of which is incorporated herein by reference in its entirety.

FIELD OF THE INVENTION

The invention relates to an aluminum-manganese (Al—Mn) based alloy composition and, more particularly, it relates to an Al—Mn based alloy composition combined with a homogenization treatment for extruded and brazed heat exchanger tubing.

DESCRIPTION OF THE PRIOR ART

Aluminum alloys are well recognized for their corrosion resistance. In the automotive industry, aluminum alloys are used extensively for tubing due to their extrudability and their combination of light weight and high strength. They are used particularly for heat exchanger or air conditioning applications, where high strength, corrosion resistance, and extrudability are necessary. The AA 3000 series aluminum alloys are often used wherever relatively high strength is required.

Typically, aluminum alloy AA 3012A (in weight %, 0.7-1.2 Mn, maximum (max.) 0.2 Fe, max. 0.3 Si, max. 0.05 Ti, max. 0.05 Mg, max. 0.05 Cu, max. 0.05 Cr, max. 0.05 Zn, and max. 0.05 Ni, other elements max. 0.05 each and max. 0.15 in total) is used as multivoid or mini-microport (MMP) extruded tubing in heat exchanger applications such as air conditioning condensers. Compared to alloy AA 3102 (in weight %, 0.05-0.4 Mn, max. 0.7 Fe, max. 0.4 Si, max. 0.1 Ti, max. 0.1 Cu, and max. 0.3 Zn), which was traditionally used for these applications, the aluminum alloy AA 3012A corrosion performance is superior, whether the tube is zincated or used bare, i.e. no protective coating.

However, alloy AA 3012A extrudability is inferior compared to alloy AA 3102, due to its higher flow stress at extrusion temperatures. This decreases the potential extrusion speed when manufacturing AA 3012A, causing cost increase. In addition, in its current form, alloy AA 3012A is susceptible to coarse grain formation during furnace brazing, which can be detrimental to corrosion resistance. A fine grain structure is usually preferred for giving a more convoluted corrosion path through the tube wall.

BRIEF SUMMARY OF THE INVENTION

It is therefore an aim of the present invention to address the above mentioned issues.

According to another general aspect, there is provided an extrudable aluminum alloy ingot consisting essentially of, in weight percent, between 0.90 and 1.30 manganese, between 0.05 and 0.25 iron, between 0.05 and 0.25 silicon, between 0.01 and 0.02 titanium, less than 0.01 copper, less than 0.01 nickel, and less than 0.05 magnesium, the aluminum alloy ingot being homogenized at a homogenization temperature ranging between 550 and 600° C.

According to another general aspect, there is provided aluminum alloy heat exchanger extruded or drawn tubes which comprise an aluminum alloy composition having, in weight percent, between 0.90 and 1.30 manganese, between 0.05 and 0.25 iron, between 0.05 and 0.25 silicon, between 0.01 and 0.02 titanium, less than 0.01 copper, less than 0.01 nickel, and less than 0.05 magnesium, the aluminum alloy being cast as an ingot and homogenized at a homogenization temperature ranging between 550 and 600° C. before extruding the homogenized ingot into tubes.

According to a further general aspect, there is provided a heat exchanger comprising a plurality of extruded or drawn tube sections having an aluminum alloy composition including, in weight percent, between 0.90 and 1.30 manganese, between 0.05 and 0.25 iron, between 0.05 and 0.25 silicon, between 0.01 and 0.02 titanium, less than 0.01 copper, less than 0.01 nickel, and less than 0.05 magnesium, the aluminum alloy being cast as a billet and homogenized at a homogenization temperature ranging between 550 and 600° C. before extruding the homogenized billet into at least one tube section.

BRIEF DESCRIPTION OF THE DRAWINGS

FIG. 5 includes FIGS. 5*a*, 5*b*, 5*c*, and 5*d*; FIG. 6 is a graph showing conductivity and dispersoid particle density as a function of homogenization temperature.

It will be noted that throughout the appended drawings, like features are identified by like reference numerals.

DETAILED DESCRIPTION

Figure 1:
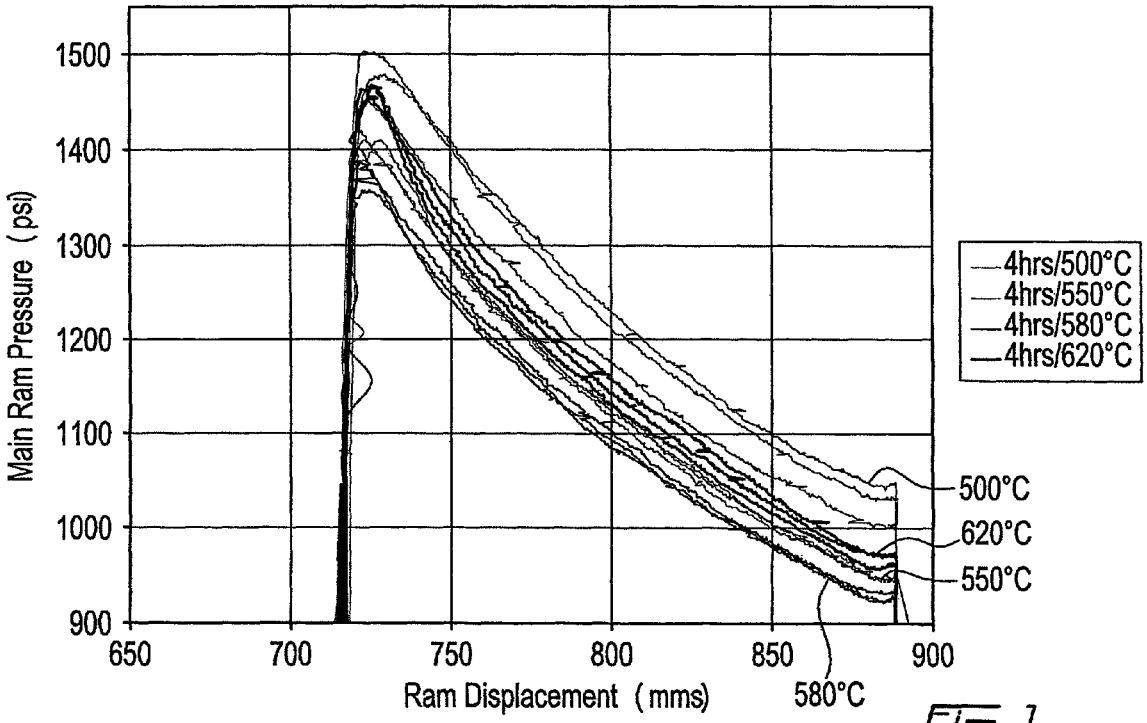
FIG. 1 is a graph showing the main ram pressure as a function of the ram displacement for billets homogenized at four different homogenization temperatures.

The aluminum alloy contains, aside from aluminum and inevitable impurities, the following amounts of alloying elements. In an embodiment, it contains approximately between 0.90 and 1.30 wt % manganese (Mn), between 0.05 and 0.25 wt % iron (Fe), 0.05 and 0.25 wt % silicon (Si), between 0.01 and 0.02 wt % titanium (Ti), less than 0.05 wt % magnesium (Mg), less than 0.01 wt % copper (Cu), and less than 0.01 wt % nickel (Ni). It can be classified as an Al—Mn based alloy. In an alternative embodiment, the aluminum alloy contains between 0.90 and 1.20 wt % Mn. In another alternative embodiment, the aluminum alloy contains less than 0.03 wt % Mg. In further alternative embodiments, the aluminum alloy contains less than 0.15 wt % Fe and/or less than 0.15 wt % Si.

The aluminum alloy composition has an impurity content lower than 0.05 wt % for each impurity and a total impurity content lower than 0.15 wt %.

The aluminum alloy is cast as an ingot such as a billet and is subjected to a homogenization treatment at a temperature ranging between 550 and 600° C. to obtain a billet/ingot conductivity of 35 to 38% IACS (International Annealed Copper Standard).

In an alternative embodiment, the aluminum alloy is subjected to a homogenization treatment at a temperature ranging between 560 and 590° C. to obtain a billet/ingot conductivity of 36.0 to 37.5% IACS.

The aluminum alloy is homogenized for two to eight hours and, in an alternative embodiment, for four to eight hours.

The homogenization treatment is followed by a controlled cooling step carried out at a cooling rate below approximately 150° C. per hour.

The homogenized ingot is reheated to a temperature ranging between 450 and 520° C. before carrying out an extrusion step wherein the ingot is extruded into tubes. In an embodiment, the extruded tubes have a wall thinner than 0.5 millimeter. The extrusion step can be followed by a drawing step. The extruded or drawn tubes can be brazed to heat exchanger components such as manifold, internal and external corrugated fins, etc.

The homogenized aluminum alloy combines high extrudability with a uniform fine surface grain structure for improved corrosion resistance.

During homogenization of Al—Mn alloys, manganese is taken into solid solution or precipitated as manganese rich dispersoids depending on the homogenization temperature and the manganese content of the alloy. In the Al—Mn based alloy composition and homogenization treatment of the invention, the resulting ingot has a microstructure with sufficient manganese out of solution to reduce the high temperature flow stress and extrusion pressure, but with manganese rich dispersoids in the correct form, i.e. size and interparticle spacing, to inhibit recrystallization during a furnace braze cycle, while still providing reduced flow stress.

The controlled homogenization cycle for the Al—Mn based alloy of the invention improves extrudability and prevents coarse grain formation during brazing.

In the alloy composition, the copper and iron contents are relatively low to obtain an adequate resistance to corrosion. The magnesium content is kept relatively low for brazeability of the alloy. Higher silicon levels depress the alloy melting point and decrease extrudability further.

Experiment 1

Extrudability Testing

Billets of an aluminum alloy having the composition shown in line 2 of Table 1 (Alloy 1) were DC cast at 178 mm diameter and machined down to 101 millimeter (mm) diameter and 200 mm in length. Groups of three billets were then homogenized for four (4) hours at temperatures ranging from 500 to 620° C. and cooled at 150° C. per hour.

The composition of alloy 1 falls within the range of AA 3012A.

The billets were then extruded in groups of three in a random sequence into an I-beam profile with a 1.3 mm wall thickness on a 780-tonne experimental extrusion press. The billets were induction heated to a nominal temperature of 500° C. in 90 seconds. The billet temperature, immediately prior to loading into the press container, was measured using contact thermocouples located on the billet loading arm. The die and press container were preheated to 450° C.; the extrusion ratio was 120:1.

Four billets of typical commercial AA 3003 (composition shown in line 3 of Table 1) were extruded initially to stabilize the press thermally. A constant ram speed of 10 mm per second (sec.), corresponding to a die exit speed of 75 meters per minute, was used throughout the test.

TABLE 1

Alloy Compositions Used in Extrudability Testing in wt %.

| Alloy | Cu | Fe | Mg | Mn | Si | Ti | Zn |
|---|---|---|---|---|---|---|---|
| 1 | 0.001 | 0.09 | <0.01 | 1.00 | 0.07 | 0.016 | 0.002 |
| AA 3003 | 0.080 | 0.56 | <0.01 | 1.05 | 0.23 | 0.016 | 0.002 |

Thermocouples were placed through holes spark eroded into the sides of the die, such that the thermocouple tip was in contact with the extruded profile, allowing the surface exit temperature to be monitored during the test. Main ram pressure was recorded throughout the test as the main measure of extrudability. The roughness of the profiles was measured in the transverse direction.

FIG. 1 shows the raw pressure data plotted against ram displacement. The shape of the curves is typical for hot extrusion processes, exhibiting a peak or "breakthrough pressure", followed by a steady decrease as the billet/container friction decreased. The extrusion pressure varied with the homogenization temperature used. More particularly, increased extrusion pressure was obtained for homogenization temperature of, in the order, 580° C., 550° C., 620° C. and 500° C.

The initial billet temperature has a strong influence on measured pressures and temperatures due to the sensitivity of flow stress to deformation temperature. To remove this effect, the trial data were analyzed and data from runs where the initial billet temperature was outside the range 490-500° C. were removed.

Table 2 gives, amongst others, values of breakthrough pressure ($P_{max}$), along with pressure at a fixed ram position (800 mm) near the end of the ram stroke ($P_{800}$), die bearing temperature (Bearing Exit Temp.), and bulk exit temperature (Exit Temp.) measured at the fixed ram position (800 mm). It also provides the breakthrough pressure variation versus the breakthrough pressure for a given homogenization temperature of 620° C.:

$$\Delta P_{max} \text{ vs } 620^\circ \text{ C. } (\%) = \frac{P_{max}^{AA3012}(T_{homo}) - P_{max}^{AA3012}(620^\circ \text{ C.})}{P_{max}^{AA3012}(620^\circ \text{ C.})} * 100,$$

the pressure variation at the fixed ram position versus the pressure at the fixed ram position for the given homogenization temperature of 620° C.:

$$\Delta P_{800} \text{ vs } 620^\circ \text{ C. } (\%) = \frac{P_{800}^{AA3012}(T_{homo}) - P_{800}^{AA3012}(620^\circ \text{ C.})}{P_{800}^{AA3012}(620^\circ \text{ C.})} * 100, \text{ and}$$

the billet conductivity (IACS).

For AA 3003 control alloy, none of the billets were in the desired temperature range and values at 495° C. were extrapolated. The extrapolated values are indicated between parentheses in Table 2.

TABLE 2

Results from Extrudability Test.

| Alloy | Homo Temp. (° C.) | $P_{max}$ (psi) | $\Delta P_{max}$ vs 620° C. (%) | $P_{800}$ (psi) | $\Delta P_{800}$ vs 620° C. (%) | Bearing Exit Temp. (° C.) | Exit Temp. (° C.) | IACS (%) |
|---|---|---|---|---|---|---|---|---|
| Alloy 1 | 500 | 1452 | −0.89 | 1174 | +2.53 | 590 | 528 | 40 |
| Alloy 1 | 550 | 1413 | −3.55 | 1122 | −2.01 | 577 | 522 | 37.6 |
| Alloy 1 | 580 | 1381 | −5.73 | 1093 | −4.54 | 577 | 522 | 36.9 |
| Alloy 1 | 620 | 1465 | . . . | 1145 | . . . | 581 | 524 | 33.7 |
| AA 3003 | 620 | (1415) | . . . | (1162) | . . . | (562) | (515) | 41.03 |

Extrudability, or the ability to extrude at high speed, is controlled by the pressure required for processing a given material and by the speed at which the surface quality deteriorates, usually when the surface of the product approaches the alloy melting point. Extrusion pressure plays a dual role; aluminum is strain rate sensitive, so that a softer material can be extruded faster with a given press capacity. Furthermore, a softer material generates less heat during extrusion, such that surface deterioration at higher extrusion speeds occurs later.

The results in Table 2 indicate that the homogenization temperature of 580° C. gave consistently lower extrusion pressures than the other homogenization temperatures. The profile surface and bulk exit temperatures were also lower. These results can be correlated with an improved surface finish.

Figure 2:
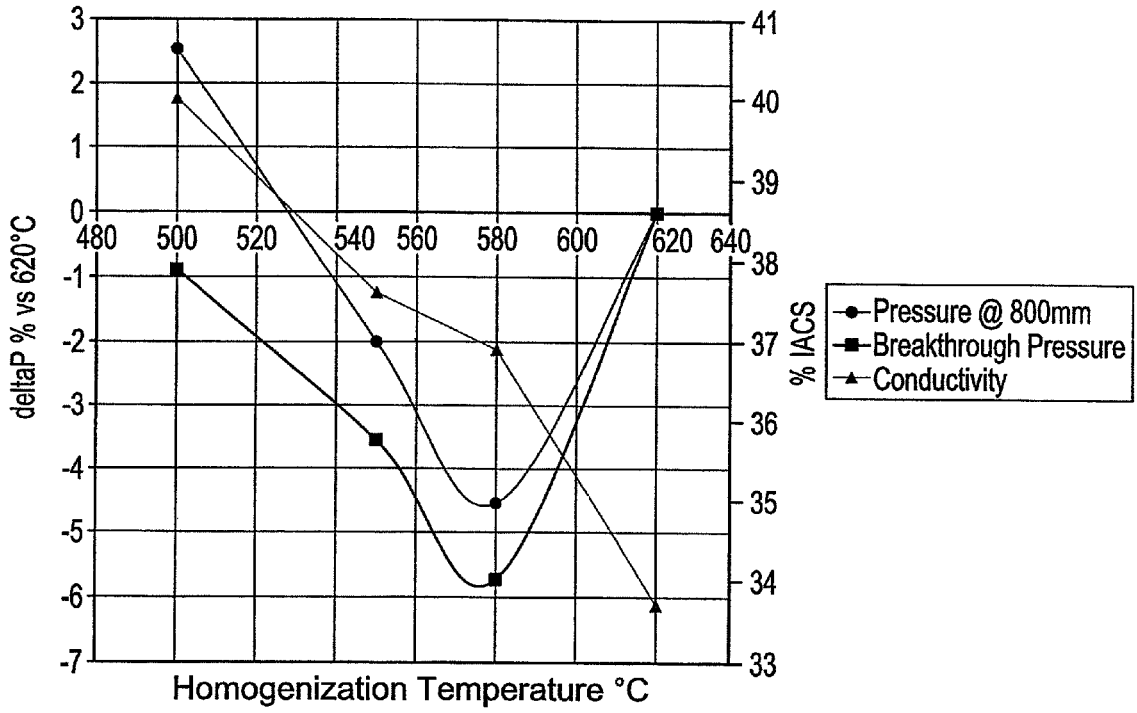
FIG. 2 is a graph showing the extrusion pressure variation in comparison to the extrusion pressure for a 620° C. homogenization temperature and the billet conductivity as a function of the homogenization temperature.

FIG. 2 is a plot of the pressure differentials (compared to pressures for the 620° C. homogenization treatment) versus the homogenization temperature. The benefits of a homogenization temperature close to 580° C. are clear from FIG. 2. The pressure increases as the homogenization temperature is increased or decreased around this homogenization temperature. Given the natural spread in temperatures in commercial operations due to the mass of metal involved and based on these experimental data, the optimal temperature range for the homogenization treatment is between 550 and 600° C.

The extrusion pressure is controlled by two factors and, more particularly, the level of manganese in solid solution and the contribution of strengthening from manganese rich dispersoids. The conductivity values (% IACS) in Table 2 are a measure of the level of solute, particularly manganese, in solid solution. FIG. 2 shows that the conductivity drops steadily as the homogenization temperature is increased due to manganese going into solid solution with a corresponding lower volume fraction of dispersoids. There is more manganese in solid solution, thus, the conductivity is lower and the extrusion pressure is higher.

However, at low temperatures, another mechanism is operating. More particularly, dispersion strengthening by the dense manganese rich dispersoids occurs through the Orowan strengthening mechanism. The optimum situation for extrusion pressure is at intermediate homogenization temperature where the combined effect of the two mechanisms is minimized. It is therefore possible to define a preferred conductivity range in the homogenized billet of 35-38% IACS for optimum extrudability.

Figure 3:
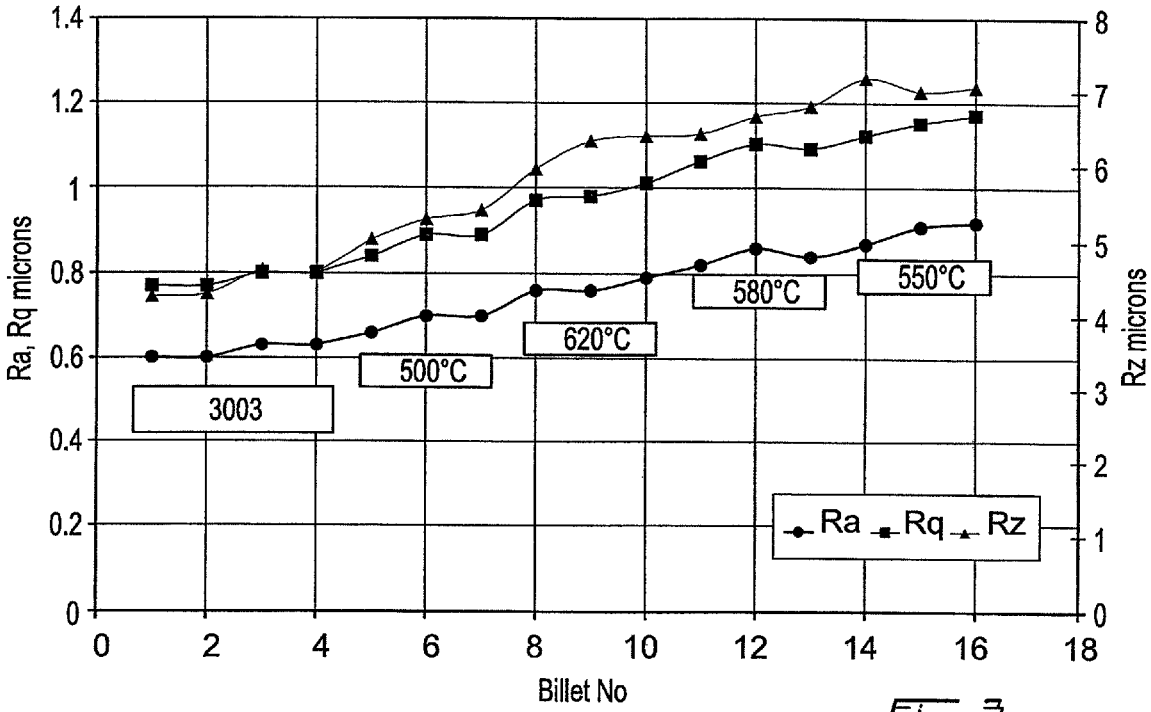
FIG. 3 is a graph showing billet roughness values (Ra, Rq, and Rz) as a function of billet sequence in a trial.

FIG. 3 shows roughness values as a function of billet sequence in the trial. The roughness values are measured by Ra, Rq, and Rz.

An important aspect of extrudability is the surface finish of the extruded product. In the tests carried out, the roughness increased with the billet number, which is typical of extrusion runs as aluminum builds up behind the die bearing. There were no significant deviations from the general trend with the various homogenization variants tested, indicating that all the variants were equivalent in this respect.

Experiment 2

Control of Grain Structure

Two other aluminum alloys (Alloys 2 and 3), falling within the range of AA 3012A, were DC cast at 178 mm diameter and machined into 101 mm diameter billets for extrusion. The compositions of both aluminum alloys are given in Table 3. Various homogenization treatments, with homogenization temperatures from 500 to 625° C. and with soak times from 4 to 8 hours, were applied to the billets prior to extruding into a 10-port microport tube with a 0.3 mm wall thickness using a billet temperature of 500° C. and a ram speed of 1.2 mm per sec. The homogenization step was followed by a controlled cooling at a cooling rate of 150° C. per hour to decrease the alloy flow stress and make it more extrudable.

TABLE 3

Alloy Compositions Tested in Experiment N° 2.

| | Cu | Fe | Mg | Mn | Si | Ti | Zn |
|---|---|---|---|---|---|---|---|
| 2 | 0.002 | 0.09 | <0.01 | 0.98 | 0.08 | 0.018 | 0.002 |
| 3 | 0.001 | 0.09 | <0.01 | 1.16 | 0.07 | 0.018 | 0.002 |

The extrusion ratio was 420/1 and the tubing was water quenched at the press exit. Lengths of tubing were then sized by cold rolling, resulting in a bulk tube thickness reduction of 4% to simulate a commercial practice. The samples were then subjected to simulated furnace brazing cycles consisting of a 20-min heat up with peak temperatures of 605 and 625° C. followed by rapid air cooling. The grain structures of the tubes were assessed by macro-etching the surface in Poultons reagent and also by metallographically preparing transverse cross sections and etching with Barkers reagent. Table 4 summarizes the test conditions and the grain structure results.

TABLE 4

Test Conditions and Grain Structure Results in Experiment N° 2.

| Alloy | Mn (wt %) | Homo. Time (hours) | Homo Temp. (° C.) | Grain Structure 600° C. Braze | Grain Structure 625° C. Braze |
|---|---|---|---|---|---|
| 2 | 1.00 | 4 | 500 | F | F |
| 2 | 1.00 | 4 | 550 | F | F |
| 2 | 1.00 | 4 | 580 | F | F |
| 2 | 1.00 | 8 | 580 | F | F |
| 2 | 1.00 | 8 | 590 | F | MCF |
| 2 | 1.00 | 4 | 620 | . . . | MCF |
| 2 | 1.00 | 8 | 625 | MCF | CG |

TABLE 4-continued

Test Conditions and Grain Structure Results in Experiment N° 2.

| Alloy | Mn (wt %) | Homo. Time (hours) | Homo Temp. (° C.) | Grain Structure 600° C. Braze | Grain Structure 625° C. Braze |
|---|---|---|---|---|---|
| 3 | 1.20 | 4 | 500 | F | F |
| 3 | 1.20 | 4 | 550 | F | F |
| 3 | 1.20 | 4 | 580 | F | F |
| 3 | 1.20 | 8 | 625 | MCF | MCF |

F: Fine surface grain;
CG: 100% coarse surface grain;
MCF: Mixed fine and coarse surface grain.

Figure 4:
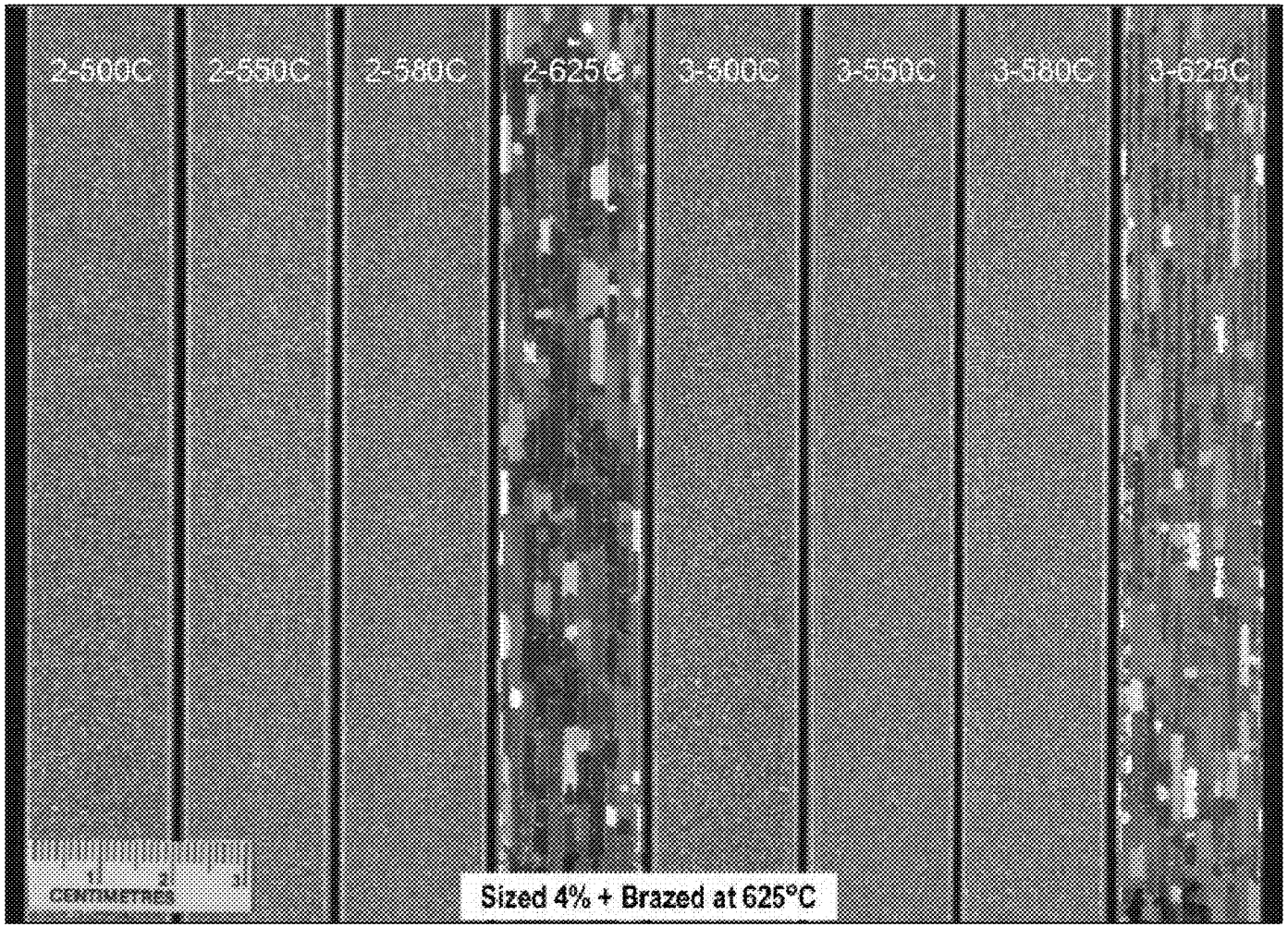
FIG. 4 is a photograph showing the surface grain structures of samples brazed at 625° C. after macro-etching for Alloys 2 and 3.
Figure 5A:
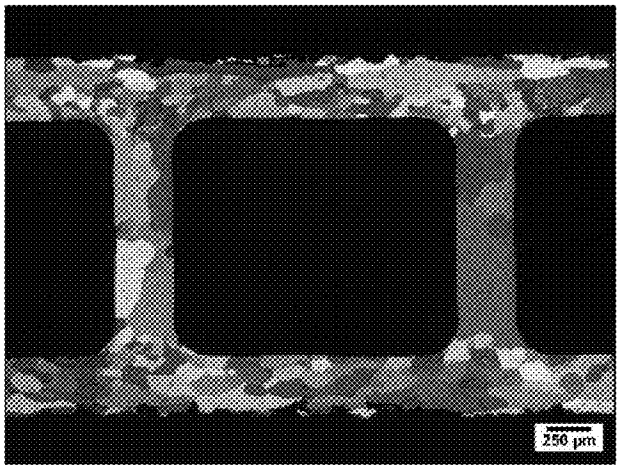
FIGS. 5*a*, 5*b*, 5*c*, and 5*d* are micrographs showing the post-brazed grain structures in the transverse plane for Alloy 1 homogenized four (4) hours at homogenization temperatures of 500° C., 550° C., 580° C., and 620° C. respectively and brazed at 625° C.
Figure 5B:
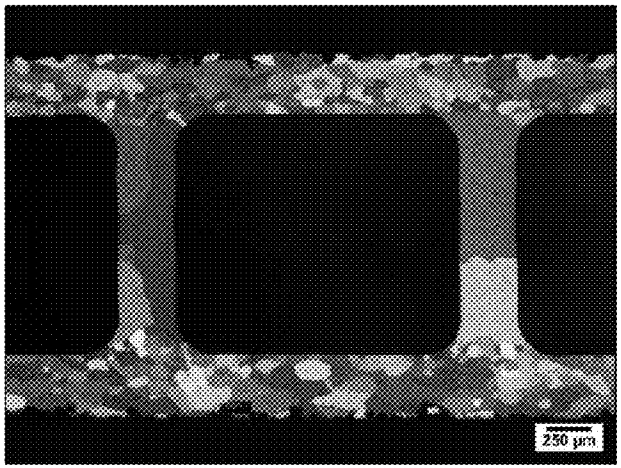
Figure 5C:
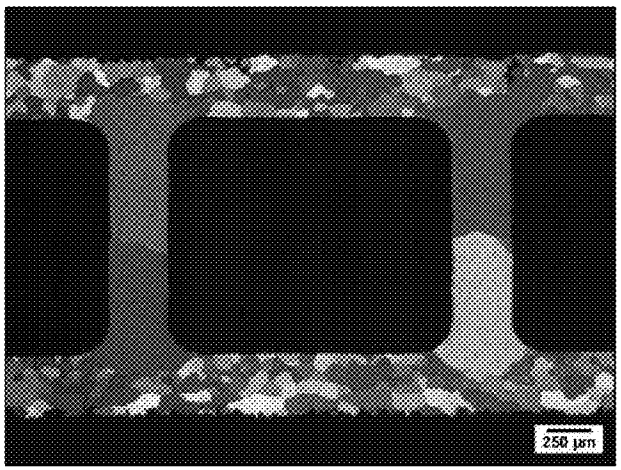
Figure 5D:
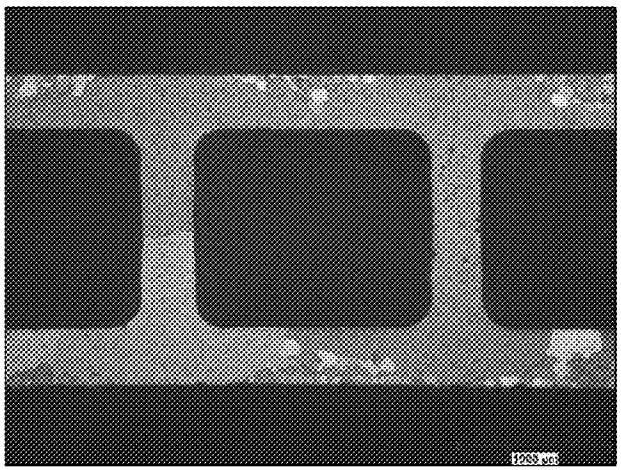

FIG. 4 shows the typical appearance of samples brazed at 625° C. after macro-etching, for Alloys 2 and 3. It shows that fine grains were present on the surface of the tubes for billets homogenized at 580° C. or less. These fine grains were the residual grain structure produced at the extrusion press. In other words, no recrystallization occurred. The large elongated grains in the tubes, for billets homogenized at 625° C. in FIG. 4, were a result of recrystallization taking place during the braze cycle. For Alloy 3, the recrystallization process was incomplete and some residual fine grains were still evident.

The results in Table 4 show the amount of coarse recrystallized grains increased with higher homogenization and brazing temperatures. Since the braze temperature in a production environment is difficult to control, it is possible that high temperatures, close to 625° C., could be encountered. Therefore, the tubing material has to be capable of retaining a fine grain structure under these severe conditions. Overall, the preferred fine surface grain structure was only possible with homogenization temperatures below 600° C. in an embodiment, and below 590° C. in an alternative embodiment.

The homogenization time had a lower influence on the grain structure in comparison to the homogenization temperature.

FIG. 5 shows typical grain structures in the transverse plane for material homogenized for four (4) hours at various homogenization temperatures and brazed at 625° C. The grain structures match those visible on the macro-etched surfaces in FIG. 4 since a continuous layer of fine grains was present at the surface for material homogenized at 580° C. or below. For the material homogenized at 620° C., some residual fine grains were still present at the surface, but coarse grains in some cases extending through the full thickness of the tube dominated the microstructure. The form of the coarse grains is a result of the initiation of the recrystallization process occurring close to the centre of the webs. During sizing, cold deformation is concentrated in the webs and, consequently, these regions undergo recrystallization more readily. Even at lower homogenization temperatures, recrystallization of the webs occurred in all cases. While prevention of recrystallization of the webs is a desirable feature as it can increase the burst strength of the tube, it is not an important feature of the current invention where a continuous layer of fine surface grains is preferred to improve corrosion resistance.

Thus, subjecting an aluminum alloy cast ingot containing, in wt %, 0.90-1.30 Mn, 0.05-0.25 Fe, 0.05-0.25 Si, 0.01-0.02 Ti, max. 0.05 Mg, max. 0.01 Cu, and max. 0.01 Ni to a homogenization treatment at a homogenization temperature from 550 to 600° C., provides a homogenized billet with a high extrudability. Furthermore, if the homogenized billet is further extruded into tubes, such as multivoid or mini-microport extruded tubing, the resulting tubes have a uniform fine surface grain structure for improved corrosion resistance.

The extruded tubes can be brazed to heat exchanger components such as manifold, internal and external corrugated fins, etc. The brazed tubes are also characterized by a fine surface grain structure.

Experiment 3

Measurement of Mn Dispersoids

A further experiment was conducted in order to quantify the microstructure in the billet in terms of the density of the manganese dispersoid distribution associated with the preferred homogenization cycle.

Alloy 4 was DC cast as a 228 mm dia billet and slices were homogenized for 4 hrs at temperatures ranging from 500 to 620° C. and cooled at 100° C./hr. Sections were taken from the mid-radius position and metallographically polished. The samples were examined at a magnification of 30,000× using a field emission SEM and the characteristics of the manganese dispersoid particles was measured using image analysis software. Three hundred observation fields each with an area of 59.3 sq. microns were used for the analysis. The equivalent circle (diameter of a circle with the same area as the particle—known as dcirc) was measured for each particle and only those with a dcirc<0.5 microns were included in the analysis on the basis that anything larger is not a dispersoid and does not contribute to flow stress. Particles with a dcirc<0.022 microns could not be measured accurately due to inadequate resolution and were also discounted from the analysis.

TABLE 5

Alloy Composition Tested in Experiment No 3.

| | Cu | Fe | Mg | Mn | Si | Ti | Zn |
|---|---|---|---|---|---|---|---|
| Alloy 4 | 0.002 | 0.09 | <.01 | 0.99 | 0.07 | 0.017 | 0.002 |

The results in terms of conductivity and number density (no. /mm$^2$) are shown in Table 6.

TABLE 6

| Temp C. | No per sq. mm/10000 | IACS |
|---|---|---|
| 500 | 47.1 | 38.6 |
| 550 | 40.8 | 38.2 |
| 580 | 31.3 | 36.5 |
| 600 | 18.1 | 34.2 |
| 620 | 7.0 | 32.3 |

These results are plotted in FIG. 6.

The microstructure associated with the homogenization temperature range of 550-600° C. can be defined by a number density of Mn dispersoids with a dcirc<0.5 microns in the range 18–41×10$^4$ per square millimeter. At the homogenization temperature range of 560-590° C., the dispersoid particle density can be characterized by a Mn dispersoid count of 25-39× per square millimeter In an alternative embodiment, the aluminum alloy contains, in wt %, 0.90-1.20 Mn. In another alternative embodiment, the aluminum alloy contains less than 0.03 wt % Mg.

The homogenized billet has a billet conductivity of 35 to 38% IACS.

With this combination of aluminum alloy composition and homogenization temperature, there is sufficient manganese out of solution to reduce the high temperature flow stress and extrusion pressure, but with manganese rich dispersoids in the correct form, i.e. size and interparticle spacing, to inhibit recrystallization of the extruded tube during a furnace braze cycle, while still providing reduced flow stress.

The embodiments of the invention described above are intended to be exemplary only. The scope of the invention is therefore intended to be limited solely by the scope of the appended claims.

What is claimed is:

1. Aluminum alloy heat exchanger extruded tubes comprising an aluminum alloy composition consisting essentially of, in weight percent, between 0.90 and 1.30 manganese, between 0.05 and 0.25 iron, between 0.05 and 0.25 silicon, between 0.01 and 0.02 titanium, less than 0.01 copper, less than 0.01 nickel, and less than 0.05 magnesium, the aluminum alloy being cast as an ingot and homogenized at a homogenization temperature ranging between 550 and 600° C. before extruding the homogenized ingot into tubes.

2. Aluminum alloy heat exchanger extruded tubes as claimed in claim 1, wherein the homogenized ingot has an ingot conductivity of 35 to 38 IACS.

3. Aluminum alloy heat exchanger extruded tubes as claimed in claim 1, wherein the aluminum alloy ingot is homogenized at a homogenization temperature ranging between 560 and 590° C.

4. Aluminum alloy heat exchanger extruded tubes as claimed in claim 1, wherein aluminum alloy ingot is homogenized for two to eight hours.

5. Aluminum alloy heat exchanger extruded tubes as claimed in claim 1, wherein the homogenization is followed by a controlled cooling step carried at a cooling rate below 150° C. per hour.

6. Aluminum alloy heat exchanger extruded tubes as claimed in claim 1, wherein the manganese content ranges between 0.90 and 1.20 wt %.

7. Aluminum alloy heat exchanger extruded tubes as claimed in claim 1, wherein the extruded tubes have a wall thinner than 0.5 mm.

8. Aluminum alloy heat exchanger extruded tubes as claimed in claim 1, wherein the extruded tubes are brazeable to at least one heat exchanger component.

9. Aluminum alloy heat exchanger extruded tubes as claimed in claim 1, wherein the density of Mn dispersoids with a dcirc less than 0.5 microns in a square millimeter area is 18-41×104.

10. Aluminum alloy heat exchanger extruded tubes as claimed in claim 2, wherein the aluminum alloy ingot is homogenized at a homogenization temperature ranging between 560 and 590° C.

11. Aluminum alloy heat exchanger extruded tubes as claimed in claim 2, wherein aluminum alloy ingot is homogenized for two to eight hours.

12. Aluminum alloy heat exchanger extruded tubes as claimed in claim 2, wherein the homogenization is followed by a controlled cooling step carried at a cooling rate below 150° C. per hour.

13. Aluminum alloy heat exchanger extruded tubes as claimed in claim 2, wherein the manganese content ranges between 0.90 and 1.20 wt %.

14. Aluminum alloy heat exchanger extruded tubes as claimed in claim 2, wherein the extruded tubes have a wall thinner than 0.5 mm.

15. Aluminum alloy heat exchanger extruded tubes as claimed in claim 2 wherein the extruded tubes are brazeable to at least one heat exchanger component.

16. Aluminum alloy heat exchanger extruded tubes as claimed in claim 2, wherein the density of Mn dispersoids with a dcirc less than 0.5 microns in a square millimeter area is 18-41×104.

* * * * *